United States Patent [19]

Gentry et al.

[11] 4,316,500

[45] Feb. 23, 1982

[54] CERAMIC HEAT EXCHANGER WITH HOT ADJUSTMENT FACE SEALS

[75] Inventors: Charles B. Gentry, Belmont; Robert M. Scanlon, Rockford, both of Mich.

[73] Assignee: Granco Equipment, Inc., Belding, Mich.

[21] Appl. No.: 153,928

[22] Filed: May 28, 1980

[51] Int. Cl.[3] ..... F28D 19/04

[52] U.S. Cl. ..... 165/9; 277/1

[58] Field of Search ..... 165/8, 9; 277/1

[56] References Cited

U.S. PATENT DOCUMENTS

| | | | |
|---|---|---|---|
| 3,024,005 | 3/1962 | Dore et al. | 165/9 |
| 3,108,632 | 10/1963 | Jensen et al. | 165/9 |
| 3,389,745 | 6/1968 | Wahlbeck | 165/9 |
| 4,024,907 | 5/1977 | Brzytwa | 165/9 |
| 4,027,721 | 6/1977 | Gentry | 165/9 |
| 4,040,474 | 8/1977 | Stroom et al. | 165/9 |

*Primary Examiner*—Albert W. Davis

*Attorney, Agent, or Firm*—John E. McGarry; Richard A. Gaffin

[57] ABSTRACT

A rotary heat exchanger (10) for a furnace or incinerator has a gap face seal structure which is adjustable during operation of the heat exchanger. A rotary wheel (40) is disposed between adjacent face seals (32, 34) in a housing (15). The face seals (32, 34) are spaced from adjacent side surfaces of the wheel (40) by a predetermined gap. The wheel (40) is carried on a shaft journalled in bearings (48, 54) mounted to a first section (11) of the housing (15). The bearings (48, 54) are coupled to the shaft (41) to permit axial displacement of the shaft (41) relative to the housing (15). The first section (11) of the housing is joined to a second section (12) by an adjustable coupling (26) to permit relative displacement therebetween. In this way, the gaps between the wheel (40) and the face seals (32, 34) can be adjusted while the wheel is hot to maintain the gaps at a minimum to reduce the thermal gradients across the wheel which may induce stresses and cracks in the wheel.

20 Claims, 3 Drawing Figures

CERAMIC HEAT EXCHANGER WITH HOT ADJUSTMENT FACE SEALS

BACKGROUND OF THE INVENTION

1. Field of the Invention

The invention relates to rotary heat exchanger wheel including a means for adjusting the dimensions of a gap face sealing arrangement provided adjacent the wheel while the wheel is hot.

2. State of the Prior Art

Furnaces and incinerators used in many industrial operations generate a relatively high amount of combustible fumes which must be eliminated from the exhaust gases, for example. In the past, the fumes have been burned in order to rid the furnace or incinerator of the combustible gases. A more efficient use of the fuel burned within the furnace would be to use the hot exhaust gases from the furnace to preheat the combustion air for the furnace.

It is known to use a rotary heat exchanger to recover the heat from the hot exhaust gases of a furnace or incinerator. In U.S. Pat. No. 4,022,571 issued May 10, 1977, to Gentry et al, such a furnace structure, including a heat exchanger for exchanging hot exhaust gases with combustion air is disclosed.

The heat exchanger which is disclosed and claimed in the above patent is formed from a ceramic material which has a relatively low coefficient of expansion. An example of such a ceramic material is Cer-Vit material which is manufactured and sold by Owens-Illinois of Toledo, Ohio. The heat exchanger is a rotating ceramic wheel which has a plurality of axially extending passages through which the combustible gas mixture passes on one side of the axis of rotation and the incinerator gases pass on the other side thereof. The ceramic wheel is mounted within a housing in accordance with the structure shown in U.S. Pat. No. 3,978,914 issued Sept. 7, 1976, to Phillips. The mounting structure includes a pair of concentric hollow shafts each carrying a wedge member at an end thereof which is biased towards the other wedge member to hold the central portion of the wheel under compression. In this way, the stresses on the ceramic wheel due to thermal expansion differences between the wheel and the mounting structure are reduced. Other types of heat exchangers may use metal wheels in place of the above-described ceramic wheel.

The heat exchanger wheel is typically provided with a gap seal arrangement which minimizes frictional drag on the wheel. A circumferential gap seal is provided about the periphery of the rotating wheel and is similar to that described in U.S. Pat. No. 4,027,721 issued June 7, 1977, to Gentry. The tapered outer surface of the ceramic wheel and an annular seal member define a small gap which provides the desired sealing structure.

In order to seal opposite sides of the heat exchanger, sealing members are provided at each face. The sealing members are typically elongate channels which extend diametrically across the wheel and spaced therefrom to define an air gap sealing relationship.

A gap seal arrangement effectively seals the edges of the wheel without creating frictional drag. Ideally, the size of the gap should be as small as possible to prevent leakage of gas between the face of the seal and the wheel since leakage may create undesirable temperature gradients. Such temperature gradients may cause thermal stresses to be formed within the wheel which could lead to cracking of the wheel.

One problem encountered with the use of gap seals is their tendency to change size as the wheel and the sealing members heat up. As the wheel heats up, expansion of the sealing material relative to the wheel causes the gap size to increase and effectively reduce the efficiency of the heat exchanger operation as well as the inducing thermal stresses. It is not possible to make these adjustments while the wheel is cold since one does not precisely know the extent of the gap seal change upon heating. Therefore, it is desirable to provide a means for adjusting the gap size during operation of the heat exchanger.

DESCRIPTION OF THE INVENTION

According to the invention, a rotary heat exchanger wheel is sealed by a gap seal arrangement which is adjustable during hot operation of the heat exchanger. The heat exchanger includes a rotary wheel having a plurality of axially extending gas passages therethrough with the wheel being mounted about an axis for rotation. The wheel is disposed within a housing formed by two sections which are axially displaceable relative to each other. A shaft on which the wheel is carried extends into the housing and the shaft is journalled in cantilevered fashion in bearings supported on a first housing section. The bearings include a first bearing member which is fixed relative to the shaft and a second bearing member which is mounted for movement with the shaft. The gap sealing arrangement includes two face sealing members, each of which is disposed on an opposite face of the wheel and adjacent thereto. The shaft and attached wheel are axially displaceable relative to both sealing members, and the two housing sections are also displaceable as described above. In this way, the spacing between the seal and the face of the wheel is adjustable to provide the desired gap size.

The two bearing members are threadably engaged to provide a means for displacing the shaft relative to the housing section. In this way, the wheel is displaceable towards and away from each of the sealing members. The two housing sections are coupled by jack bolts which permit movement of the housing sections. A compressible seal material is preferably arranged between the two housing sections to provide for the housing adjustment.

In order to adjust the size of the gap seals, the shaft carrying the wheel is first displaced towards the seal disposed in the second housing section which is the hot side of the heat exchanger. When the wheel contacts the seal, it is then displaced in an opposite direction to contact the second cold side sealing member which is secured in the first housing section to thereby define the distance between the two sealing members. The wheel is then backed off a slight distance in order to form the desired gap size between the face of the wheel and the cold side seal. The other gap seal is adjusted by displacing the two housing sections relative to each other. During this step, the shaft, the wheel and the cold side seal, which are all carried by the first housing section, are displaced toward the hot side seal. Accordingly, the size of the gap seals in the rotary heat exchanger is adjustable during operation of the heat exchanger in a relatively easy fashion. The seal size can therefore be adjusted during operation to minimize the pressure gradients created by gas flow through the gaps.

BRIEF DESCRIPTION OF THE DRAWINGS

The invention will be described with reference to the accompanying drawings in which like members bear like reference numerals, in which.

DESCRIPTION OF THE PREFERRED EMBODIMENT

Figure 1:
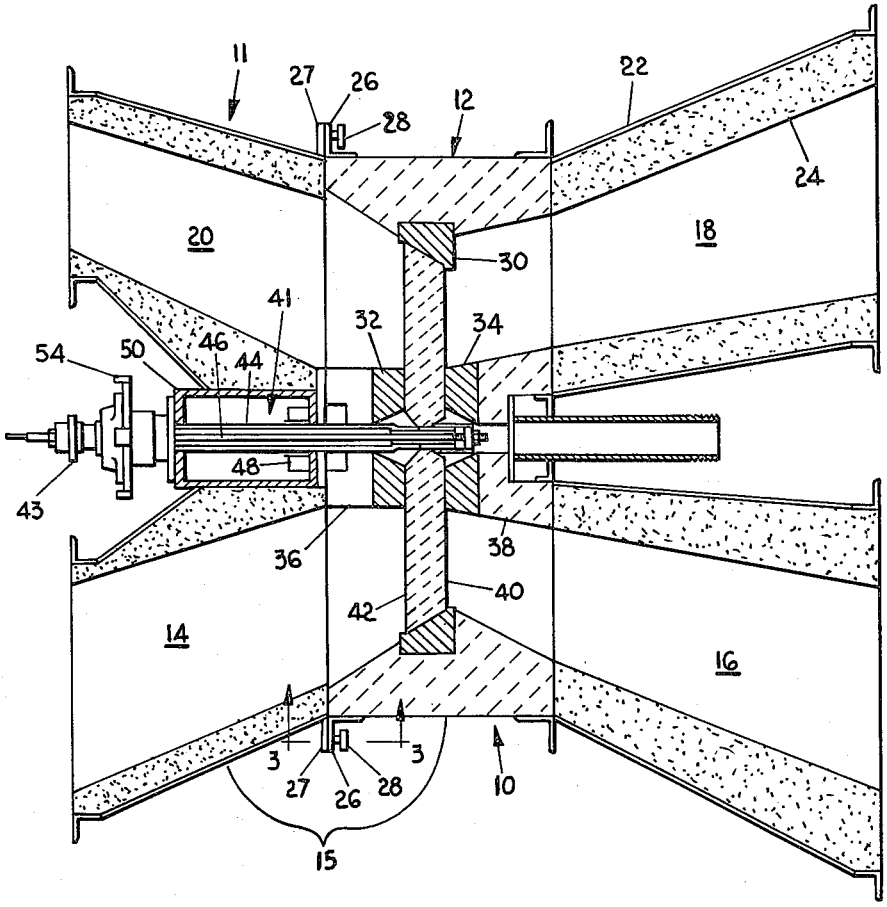
FIG. 1 is a cross-sectional view of an incinerator or furnace having a heat exchanger wheel with an adjustable seal structure according to the invention.

With reference to FIG. 1, there is shown a heat exchanger structure 10 which may form part of an incinerator or furnace such as that disclosed in U.S. Pat. No. 4,022,571 issued May 10, 1977. In the case of an incinerator, the heat exchanger 10 exchanges the hot exhaust fume gases of a drying oven for example, with the incinerator exhaust. The oven exhaust gases are drawn through an inlet duct 14 and pass through a rotary regenerative heat exchanger wheel 40 which operates within a housing 15. The heat exchanger housing 15 and the ductwork comprise two sections 11 and 12. The outlet of the heat exchanger 10 communicates to a duct 16 which leads to a combustion chamber for further eliminating combustible materials from the exhaust. After passing through the combustion chamber, the gases are drawn through a duct 18 into the other side of the heat exchanger wheel 40 and exit through an exhaust duct 20 through which the gases are exhausted to the atmosphere. Accordingly, the oven exhaust gases are preheated during flow through the wheel 10 which exchanges the heat of the gases burned in the incinerator with the gases exhausted by the oven.

The ducts have a metal wall 22 which is lined with a refractory material 24. Flanges 26 and 27 provided at the adjoining portions of the housing sections 11, 12 secure the sections together. Jack bolts 28 extend through the flanges 26, 27 to provide an adjustable coupling. Within the heat exchanger housing 15, which is also lined with a refractory material, are three sealing elements. A circumferential seal 30 is disposed about the periphery of the heat exchanger wheel 40 in a gap sealing arrangement. A pair of face seals 32 and 34 disposed on opposite sides of the wheel 40 adjacent thereto also define a gap seal arrangement. The face seals are typically made from a thermally stable refractory material, such as vacuum laminated ceramic fibers. The face seals 32 and 34 are secured to a block of refractory materials 36, 38 which are part of the housing. Accordingly, the left face seal 32, which is the cold side of the heat exchanger, is secured to the first housing section 11 whereas the righthand face seal 34, carried in the hot side of the heat exchanger, is secured to the ceramic material 38 which forms part of the second housing section 12.

Figure 2:
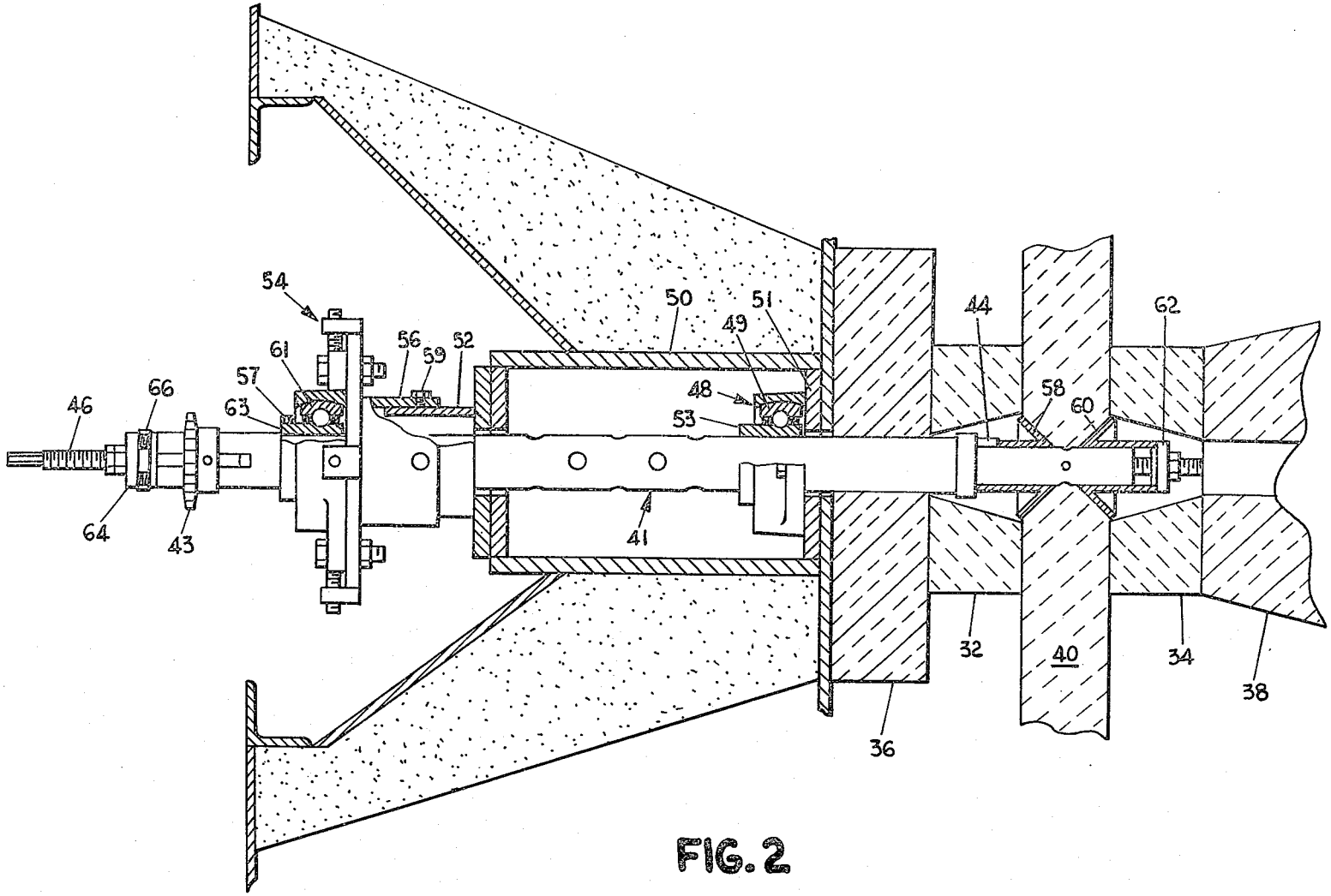
FIG. 2 is an enlarged cross-sectional view of the bearing and shaft structure.

The heat exchanger wheel 40 is rotatable within the heat exchanger housing section 12 on a shaft structure 41. The shaft structure 41 is rotatably powered through a sprocket 43 which is driven by a chain drive connected to a motor (not shown). The heat exchanger wheel 40 includes a plurality of axially extending passages 42 for passage of gases therethrough. Rotary regenerator wheels of the ceramic type are well known and are desirably made from a thermally stable ceramic material such as Cer-Vit material manufactured by Owens-Illinois of Toledo, Ohio. The heat exchanger wheel 40 has a solid ceramic core which is attached to a shaft structure 41 such as that described in U.S. Pat. No. 3,978,914 issued Sept. 7, 1976. The mounting structure for the wheel 40 includes a pair of flared flanges 58, 60 which hold the central core of the wheel 40 under compression (FIG. 2). The shaft structure 41 includes a pair of concentric hollow shafts 44 and 46 such as that described in the 3,978,914 patent. The hollow shafts provide for the mounting of the wheel, as described above, as well as providing for supply of cooling gases to the central core of the wheel.

Referring to FIG. 2, the details of the bearing and shaft structure are therein shown. The wheel 40 is secured on the shafts by the pair of generally wedge-shaped flanges 58, 60 which are disposed on opposite sides of the wheel. The flange 60 is secured to an end cap 62 which is threaded on to threaded shaft 46. The flange 58 is secured to the hollow shaft 44. The shaft 46 is a threaded member and carries an end cap 64 disposed adjacent to the outer end of shaft 44. Disposed between the end of shaft 44 and the end cap 64 is a spring 66 which serves to bias the shaft 44 and the threaded member 46 to provide the desired compressive forces between the wedge members 58 and 60.

The shafts 44 and 46 are journalled in a pair of bearings 48 and 54. The bearing 48 includes an outer race 49 which is fixed to a plate 51 of the housing 50 and an inner race 53 which is slidable on shaft 44. The bearing housing 50 is secured to the heat exchanger housing section 11 so that the bearing 48 is stationary with respect to the axis of the shaft. A tubular portion 52 having a threaded outer surface is provided on the housing 50.

The bearing 54 is fixed on the shaft structure and is axially displaceable with the shafts 44 and 46 and the heat exchanger wheel 40. An outer bearing race 61 carries a tubular member 56 having an internal threaded surface. An inner bearing race 63 is slidable on the shaft 46 and selectively secured thereto by set screws or bolts 57. Accordingly, the bearing 54 is coupled to the shafts through the inner bearing race 63 and displaceable with the shafts.

The internal threaded surface of tubular member 56 receives the thread on the tubular portion 52 to couple the bearings and the shafts in an axially displaceable relationship. The relative positions of the tubular portion 52 and the tubular member 56 are locked by set screws or bolts 59.

Figure 3:
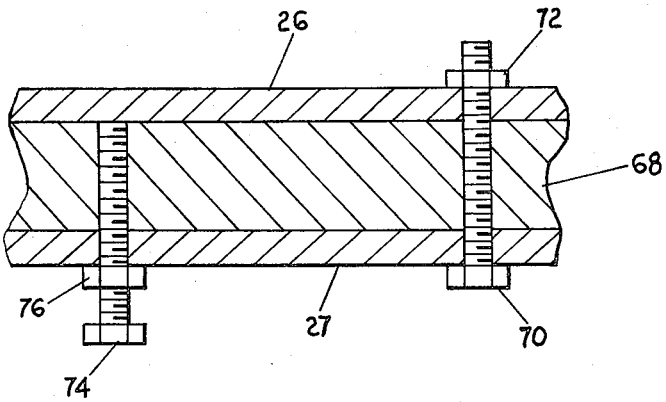
FIG. 3 is a partial cross-sectional view taken along line 3—3 of FIG. 1 showing the connection between the two housing sections according to the invention.

With reference to FIG. 3, details of the connection between the two housing sections 11 and 12, and more specifically flanges 26, 27 carried by the housing sections, is shown. The flanges 26 and 27 are joined by a pair of jack bolts 70 and 74. The bolts, which are threaded members, allow for displacement of the flanges and thus the housing sections towards and away from each other. A compressible sealing material 68 is disposed between the adjoining flanges 26, 27 to allow for the desired axial displacement. The bolt 70 carries a nut 72 at an end thereof and the bolt 74 is provided with a nut 76 near the head thereof for providing a means of displacing the two sections relative to each other. Thus, the bolt 70 draws the two flanges 26, 27 towards each other while the bolt 74 maintains a predetermined spacing between the flanges.

In operation, the ceramic heat exchanger wheel 40 in the housing is adjusted to properly space the face seals from the wheel before start-up. As the wheel 40 and seals 32, 34 are heated during the heat exchange operation, the gap size will change. In order to adjust the gap size to maintain the gap seals at the desired minimum spacing, the position of the shafts 44, 46 and attached heat exchanger wheel 40 relative to the face seals 32, 34 as well as the relative positions of the two housing sections 11, 12 are adjusted.

The bearing 54 which is attached to the shaft structure 41 is rotated so that the ceramic wheel 40 moves toward the hot side face seal 34 until it contacts the same. The rotation is accomplished by turning the threaded portion 56 of the bearing 54 on the matching thread 52 carried on the housing of the stationary bearing 48. An ammeter is typically provided on the motor which drives the heat exchanger wheel 40 so that contact of the wheel 40 with the face seal is detected by an increase in the current flow through the motor.

After the wheel contacts the hot side face seal 34, the direction of rotation is reversed so that the wheel 40 travels in the opposite direction to contact the cold side face seal 32. The distance between the two face seals can therefore be determined by multiplying the number of turns of the shaft times the pitch of the threaded shaft. The gap between the cold side face seal 32 and the ceramic wheel is then adjusted by rotating the shafts so that the wheel moves a slight distance away from the cold side seal 32.

In order to adjust the gap between the hot side face seal 34 and the ceramic wheel, the adjustment feature which couples the two housing sections 11 and 12 is employed. Since the distance between the two face seals is known, the gap which remains between the hot side seal 34 and the ceramic wheel 40 may also be calculated. Accordingly, the jack bolts 70, 74 may be tightened to move the first housing section 11 along with the shafts and ceramic wheel which are carried on the first housing section towards the hot side seal 34 a predetermined distance. The jack bolts maintain one housing section in a relatively stationary position while moving the other section towards that housing. Since the joint between the two housings includes a thick, compressible seal material 68, the displacement of one housing relative to the other may be easily made without affecting the integrity of the seal between the two flanges 26 and 27.

The foregoing operation allows the gap seals between the ceramic wheel and the face seal to be readily adjusted. It should be noted that during adjustment of the gap between the face seals and the ceramic wheel, the spacing between the periphery of the wheel and the circumferential seal 30 is also being adjusted. Thus, the use of an axially movable shaft which carries a ceramic heat exchanger wheel, as well as the provision of an adjustment feature between housing sections, allows the gaps which form the sealing arrangement to be maintained at a minimum spacing. In this way thermal differentials caused by gas passage along the gaps are minimized to thereby reduce stressing of the ceramic wheel which may lead to deterioration of the wheel. The adjustment features of the invention allow the gaps which define the seals to be adjusted during hot operation of the heat exchanger. In this way, thermal expansion of the wheel and the seals may be compensated for by realigning the relative positions of the wheel and the seals.

Other arrangements for detecting the contact of the wheel with the seals may be employed instead of the above-described ammeter. For example, a sonic device which detects the contacting of the wheel with the seal may be employed.

The invention has been described with reference to a heat exchanger for an incinerator. However, the heat exchanger could be used also for other heat exchange functions such as heating combustion air for a furnace by heat exchange with hot furnace exhaust gases. In such an application, the combustion air would be introduced through duct 14 and would pass to the furnace burners through duct 16. The furnace exhaust gases would pass through duct 18 and be exhausted through duct 20. Accordingly, the combustion air and the hot exhaust gases pass in a counter-current flow heat exchanger to preheat the combustion air.

Whereas the invention has been described with respect to a ceramic heat exchanger wheel, the invention can also be carried out with a metal heat exchanger wheel.

The foregoing specification and drawings are merely illustrative of the invention and are not intended to limit the invention to the disclosed embodiment. Variations and changes which are obvious to one skilled in the art are intended to be within the scope and nature of the invention which is defined in the appended claims.

The embodiments of the invention in which an exclusive property or privilege is claimed are defined as follows:

1. In a heat exchanger for hot gases including a heat exchanger wheel having a plurality of axially extending gas passages therethrough and means for mounting said wheel for rotation about a central axis thereof comprising:

first and second housing sections defining a heat exchanger housing;

shaft means journalled within said first housing section for rotatably mounting said wheel;

bearing means mounted to said first housing section for supporting said shaft means;

a first sealing member secured within said first housing means and a second sealing member secured within said second housing section, said sealing members being disposed adjacent opposite faces of said wheel and diametrically across the face of said wheel to form gap seals;

the improvement which comprises:

means for axially displacing said wheel relative to said sealing members while said wheel is hot and rotating; and means for displacing said first and second housing sections relative to each other;

whereby said wheel is axially displaceable to adjust the gap of the seal and to form the gap seal between said wheel and said first sealing member and said housing sections are displaceable to adjust the gap of the seal and to form the gap seal between said wheel and said second sealing member.

2. The heat exchanger of claim 1 wherein said bearing means includes:

a first bearing member fixedly mounted in said first housing section; and a second bearing member mounted on said first housing section and axially translatable relative thereto.

3. The heat exchanger of claim 2 wherein said means for axially displacing said wheel includes:

threaded means for coupling said bearing members in an axially displaceable relationship whereby said second bearing member is displaced relative to said first bearing member, thereby displacing said shaft means and attached wheel along a longitudinal axis.

4. The heat exchanger of claim 3 wherein said bearing members are disposed in housings carrying engaging threaded portions.

5. The heat exchanger of claim 4 wherein said housing in which said first bearing member is disposed is secured to the first heat exchanger housing section.

6. The heat exchanger of claim 5 wherein said housing in which said second bearing member is disposed is supported about said shaft means.

7. The heat exchanger of claim 1 wherein said means for axially displacing said first and second housing sections includes adjustable bolt means for displacing said housing sections relative to each other.

8. The heat exchanger of claim 7 including a compressible seal arranged between said first and second housing sections.

9. The heat exchanger of claim 8 wherein said bolt means includes at least two bolts coupling said heat exchanger housing sections which extend through said compressible seal.

10. The heat exchanger of claim 1 wherein said sealing members are formed of a refractory material.

11. The heat exchanger of claim 10 wherein said refractory material is a machinable material.

12. The heat exchanger of claim 1 wherein said wheel has a tapered circumferential surface and further comprising a circumferential sealing member having a tapered surface surrounding and adjacent said wheel to define an annular gap seal.

13. The heat exchanger of claim 12 wherein said gap of said annular gap seal is adjusted by axial displacement of said shaft means and said housing sections.

14. A method of adjusting the gap of a gap sealing arrangement formed by a rotary heat exchanger wheel and a pair of sealing members disposed in diametrical relationship adjacent opposing faces of said wheel while the wheel is rotating, said method comprising the steps of:

rotating said wheel about a central axis;

heat exchanger gas passing through one side of said rotating wheel with a gas passing through on other side of said wheel, thereby elevating the temperature of said wheel and sealing members;

axially displacing said rotating wheel towards a first sealing member until said wheel contacts said first sealing member;

axially displacing said wheel away from said first sealing member until said wheel contacts said second sealing member;

calculating the distance between said face seals by determining the axial displacement of said wheel between the face seals;

axially displacing said wheel towards said first sealing member a predetermined distance to form a small gap seal defined by the second sealing member and said wheel; and displacing said wheel and said second sealing member towards said first sealing member a second predetermined distance to form a small gap seal defined by the first sealing member and said wheel.

15. The method of claim 14 wherein the first and second axial displacing steps each include the step of detecting contact between the wheel and each of the sealing members by measuring a variation in the power supplied to the wheel.

16. The method of claim 15 wherein said variation in power supply is detected by an ammeter which measures the current flow in a motor which drives the wheel.

17. The method of claim 14 wherein said wheel is carried on a rotatable shaft and including the step of translating said shaft relative to the seals to axially displace said wheel.

18. The method of claim 17 wherein said shaft is supported by bearings and including the step of displacing said bearings relative to each other to translate said shaft.

19. The method of claim 18 wherein the axial displacement of the wheel is determined by multiplying the pitch of the shaft threads by the number of turns through which the shaft is turned to displace said wheel.

20. The method of claim 19 wherein said distance by which said wheel and second sealing member are displaced towards said first sealing member is the calculated distance between the two sealing members minus twice the predetermined distance by which said wheel is displaced towards the first sealing member.

* * * * *